United States Patent [19]

Knight

[11] Patent Number: 4,928,860

[45] Date of Patent: May 29, 1990

[54] DISPENSING CONTAINER

[76] Inventor: Jeffrey J. Knight, 426 Fairgrounds Rd., West Kingston, R.I. 02892

[21] Appl. No.: 300,512

[22] Filed: Jan. 23, 1989

[51] Int. Cl.[5] ..... A47G 19/14

[52] U.S. Cl. ..... 222/466; 222/184; 220/70; 215/1 C

[58] Field of Search ..... 222/465.1, 466–468, 222/185, 166, 184; 220/69–70, 94 R, 94 A; 215/1 C

[56] References Cited

U.S. PATENT DOCUMENTS

| | | | |
|---|---|---|---|
| 427,635 | 5/1890 | Sutton | 222/185 |
| 1,617,992 | 2/1927 | Drake | 222/466 |
| 3,250,434 | 5/1966 | Howlett | 222/465.1 X |
| 4,127,206 | 11/1978 | Virog, Jr. et al. | 215/1 C |
| 4,658,975 | 4/1987 | Cone | 215/100 A |
| 4,781,314 | 11/1988 | Schoonover et al. | 222/465.1 |
| 4,805,808 | 2/1989 | Larson | 222/185 |

FOREIGN PATENT DOCUMENTS

| | | | |
|---|---|---|---|
| 867042 | 3/1971 | Canada | 222/465.1 |
| 1465560 | 12/1966 | France | 222/466 |

*Primary Examiner*—Michael S. Huppert
*Attorney, Agent, or Firm*—Robert J. Doherty

[57] ABSTRACT

A dispensing container adapted to dispense viscous, slow-flow materials in such a manner that they may be entirely removed from such container. At least one of the walls comprising the container is provided with an alternate supporting surface which in combination with a sloped adjacent wall may be utilized to place the container in an alternate position such that the liquid contained therein has time to drain to the dispensing opening in such alternate position.

7 Claims, 3 Drawing Sheets

DISPENSING CONTAINER

BACKGROUND AND OBJECTS OF THE INVENTION

The present invention relates to a container specifically designed to entirely dispense all the liquid contents housed therein especially when such liquids are of a viscous, slow-flow type. More specifically, the container is constructed to present alternate surfaces upon which it may be supported, at least one of which supports the container in a dispensing position. Also, although the invention will be hereinafter described in relationship to such viscous, slow-flow liquids, it should be brought out that it has equal applicability for other liquids when it is desired to completely empty the container contents albeit more quickly with normal liquids.

Heretofore, containers containing a small amount of liquid, especially of a viscous, slow-flow type such as hair shampoo or hand cream, presented difficulty for the user to completely empty the contents. To overcome this problem, the use either discarded the container with the remaining product left therein thus causing undesirable waste or repeatedly shook or pounded the container on a supported surface to force the product to more quickly drain towards the dispensing opening. Such latter approach results in unintended damage or at least user frustration; and, accordingly, some users have resorted to propping the container in an inverted position and patiently wait for the contents to settle at the closed dispensing end thereof. Towards this latter approach, it would be useful if a container of this general type could be designed and constructed such that inverted or at least alternate use positioning could be accomplished in a convenient and safe manner.

Accordingly, an object of the present invention is to provide a dispensing container with an alternate supporting surface such that the viscous liquids contained therein may flow by gravity to an inverted position dispensing opening and thus eliminate the need for such containers to be artificially propped up in such an inverted position or other mechanisms fabricated to dispense the remaining contents therefrom.

Another object of the present invention is to provide a container that enables such to be positioned in an alternate position to assure complete liquid dispensing of viscous products yet accomplishes such in an economical and easily produced commercial-type container. These and other objects of the present invention are accomplished by a dispensing container for assuring complete drainage of liquids especially slow flow liquids contained therein, said container having a bottom wall for normally supporting said container in a first non-dispensing upright position, side walls extending upwardly therefrom and a connecting top wall, a dispensing opening and closure disposed in said top wall proximal one side thereof, said top wall sloping downwardly from said one side proximal to said dispensing opening to the top wall side opposite said one side, and an upper support spaced above said top wall and having an upper generally flat supporting surface generally parallel to said bottom wall such that liquid gravity drains from said top wall to said opening when said container is supported in an inverted alternate dispensing position by said upper supporting surface.

Previous attempts to solve this and similar dispensing problems have resulted in the presentation of such constructions as shown in the following U.S. Pat. Nos.: No. 2,831,610 to Dennie issued Apr. 22, 1958; No. 3,151,785 to Scarpa issued Oct. 6, 1964; No. 3,329,317 to Greenquist issued July 4, 1967; No. 3,407,971 to Oehler issued Oct. 29, 1968; No. 4,003,503 to Aldridge issued Jan. 18, 1977; No. 4,722,463 to Anderson issued Feb. 2, 1988; and No. 4,723,671 to Mears issued Feb. 9, 1988. Of particular interest also is a discussion of related prior art in Column 1 of the Mears patent which itself discloses a separable bottle cap stand supported by the lid closure means of a dispensing container. While of interest, these structures fail to accomplish the overall objects of the present invention in a simple and inexpensive manner.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
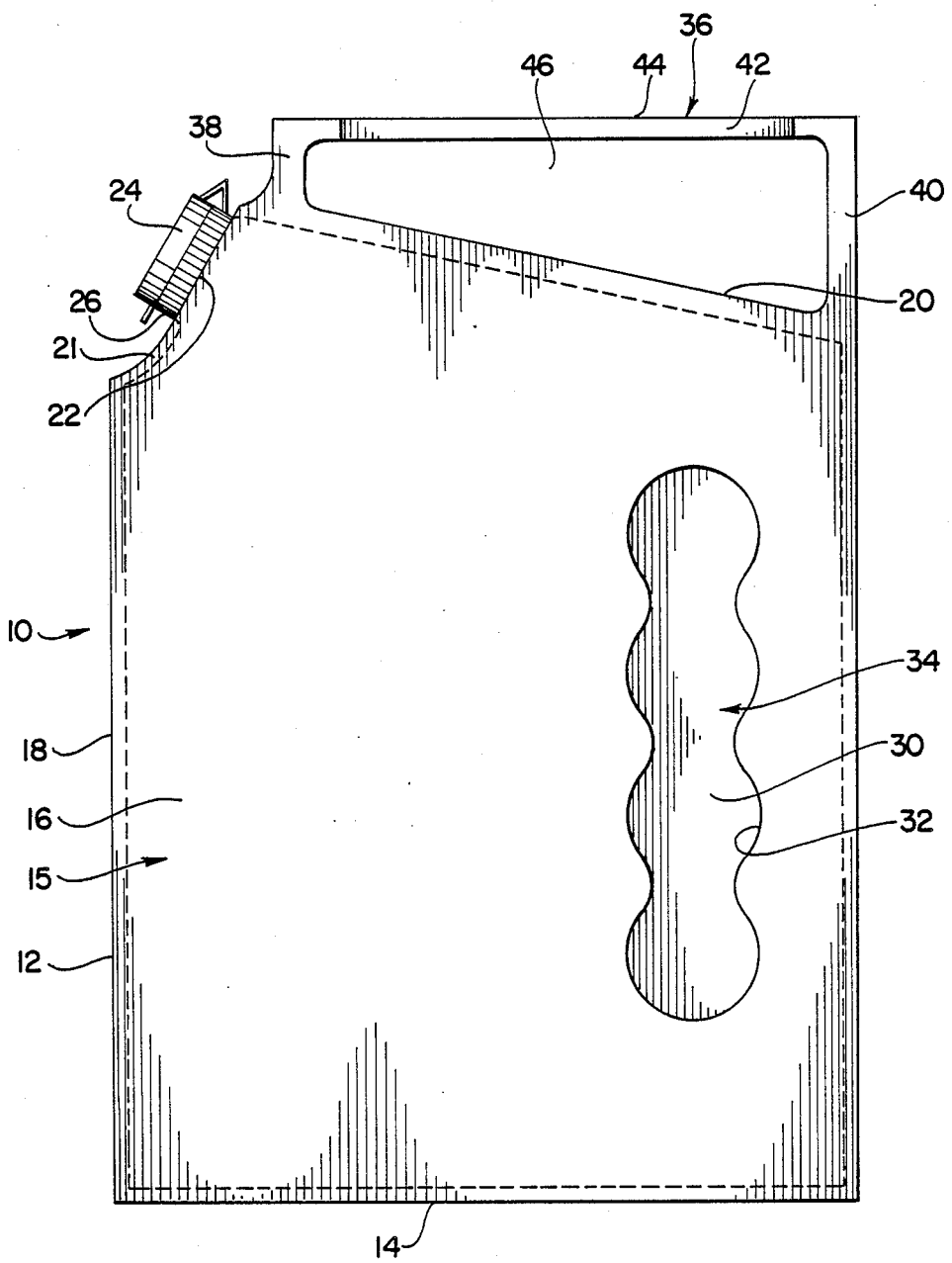
FIG. 1 is a side elevational view of one form of the container construction of the present invention.

Turning now the drawing and more particularly FIG. 1, the overall container construction 10 is depicted. The container 10 generally includes a body 12 comprising a bottom wall 14 of generally planar configuration, a pair of upstanding opposed side panels 16, and a pair of similarly disposed end panels 18. Of course, the above is described relative to a container 10 which is of general rectilinear cross-sectional configuration although the container of the present invention could take other forms.

In addition, the container 10 is provided with a top wall 20 a portion of which is proximal an end panel 18 and includes a dispensing opening 22 therethrough and a closure element 24. In this regard, the opening 22 is additionally provided with an upstanding spout structure 26 on which the closure is frictionally attached. That portion 21 of the top wall in which the dispensing opening 22 is disposed in illustrated as being an upwardly slanted wall but may, however, take other configurations such as a more conventional squared corner, the important feature being that at least a portion of the dispensing opening 22 is in line with or below that portion of the top wall 20 proximal thereto. The remaining top wall 20 portion as should be apparent from FIG. 1 is downwardly slanted away from the dispensing opening 22 to its lowermost position to the far right of FIG. 1 where it is integrally attached to the other end panel 18. In this respect, it should be brought out that the side and end panels 16, 18 cooperatively form side walls 15, that is, the term "side walls" generically refers to the container structure enclosure and is especially apt in describing a container body 12 cross-sectional configuration that is not of standard rectilinear configuration.

To grip the container body 12 which is important especially when dealing with larger containers, the side panels 16 may be provided with a depressed panel portion 30 connected to the main side panel 16 by inwardly extending walls 32 which form a surface against which the user's fingers or thumbs may be placed to better grasp the container. Such depressed panel or panels as such may be provided on one or both of the side panels 16 and provides the means by which a handle grip 34 is formed. The top wall 20 is also provided with an upper support 36 in the form of a pair of upright integral posts 38 and 40 upwardly extending from opposite ends of the top wall 20. A connecting wall 42 serves to join the upstanding posts or brackets 38, 40 together and includes a generally flat upper surface 44 which is generally parallel to the container bottom wall 14.

Figure 2:
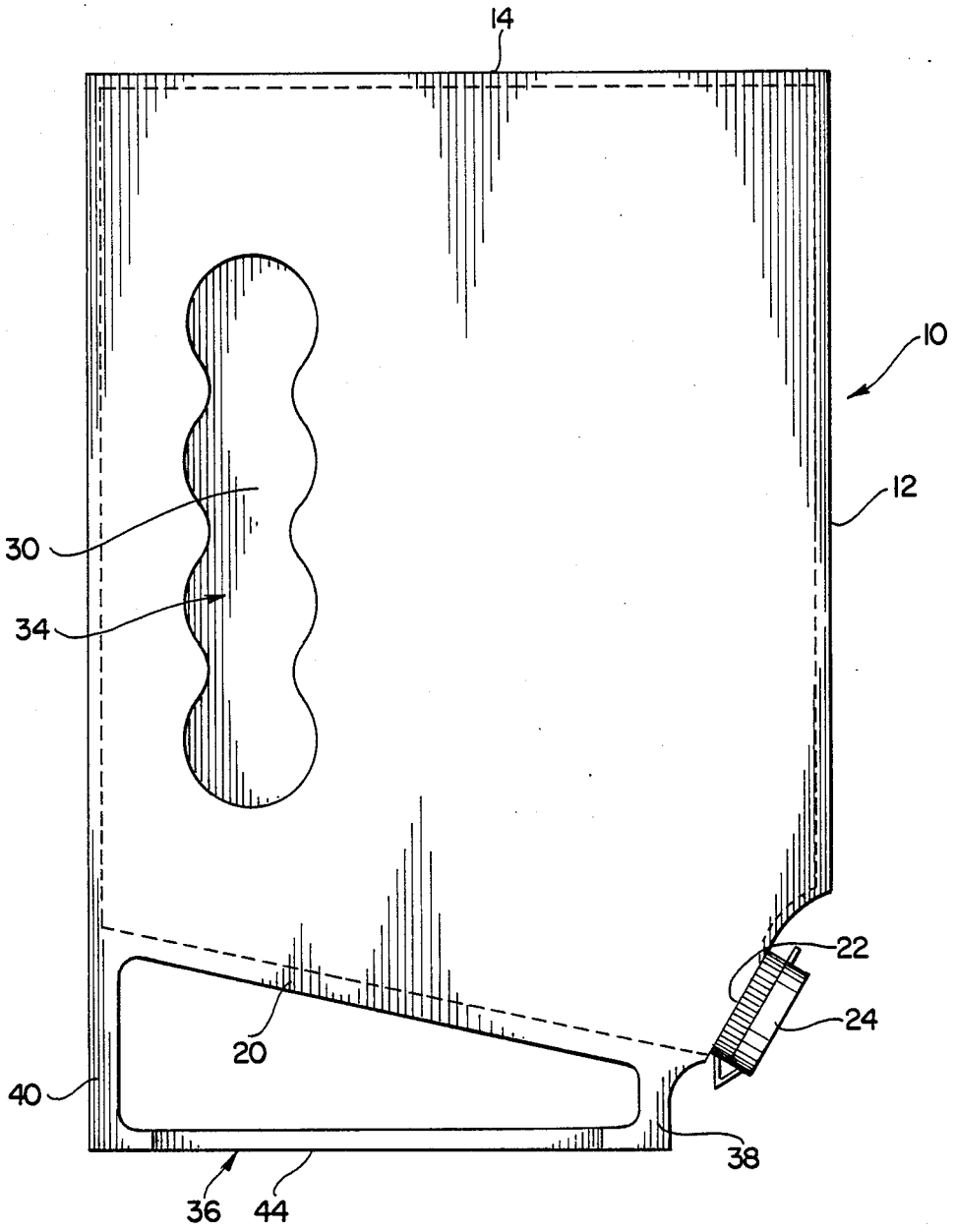
FIG. 2 is an inverted position view of the container shown in FIG. 1 showing the manner in which last amount dispensing can take place.
Figure 3:
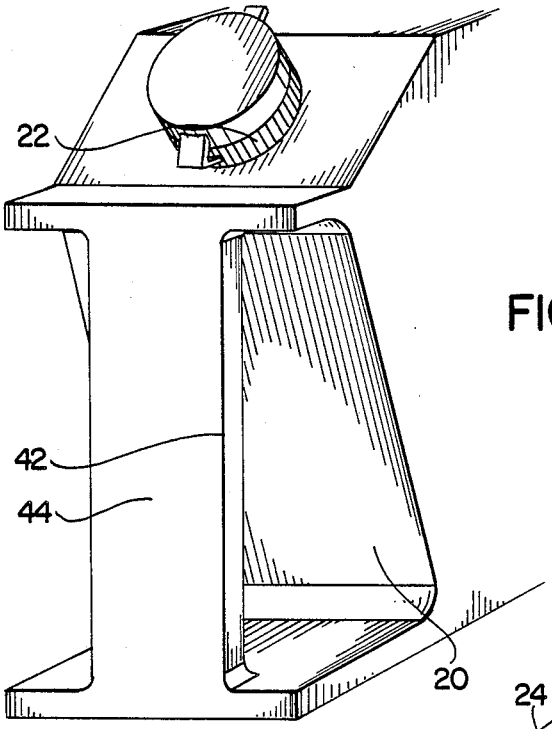
FIG. 3 is a partial perspective view of the upper portion of the container shown in FIGS. 1 and 2 and shows particularly the construction of the alternate supporting surface and handle.

It may thus be apparent particularly by reference to FIG. 2 that this surface 44 is adapted to support the container in its alternate inverted dispensing position. From such view, it may be further apparent the top wall 40 is positioned such that it provides a downwardly slanted by which viscous, slow-flow material contained within the body 12 may slowly flow towards and collect in the container area adjacent the dispensing opening 22. Thus dependent on the flow characteristics of the material being dispensed from the container 10, the user can resort to the inverted position as shown in FIG. 2 and/or maintain such position anytime the contents therein are not readily dispensed by a periodic inversion of the container in the normal dispensing mode. Thus the container 10 may be returned to storage such as in a refrigerator or cabinet in the inverted position and maintained therein by the upper support 36.

It should be pointed out that the upper support 36 additionally may exhibit an extensive opening 46 above the upper wall 20 and below the connecting wall 42. In this manner, the connecting wall 42 may be grasped by the user and utilized as a secondary handle support or carrying mechanism.

Figure 4:
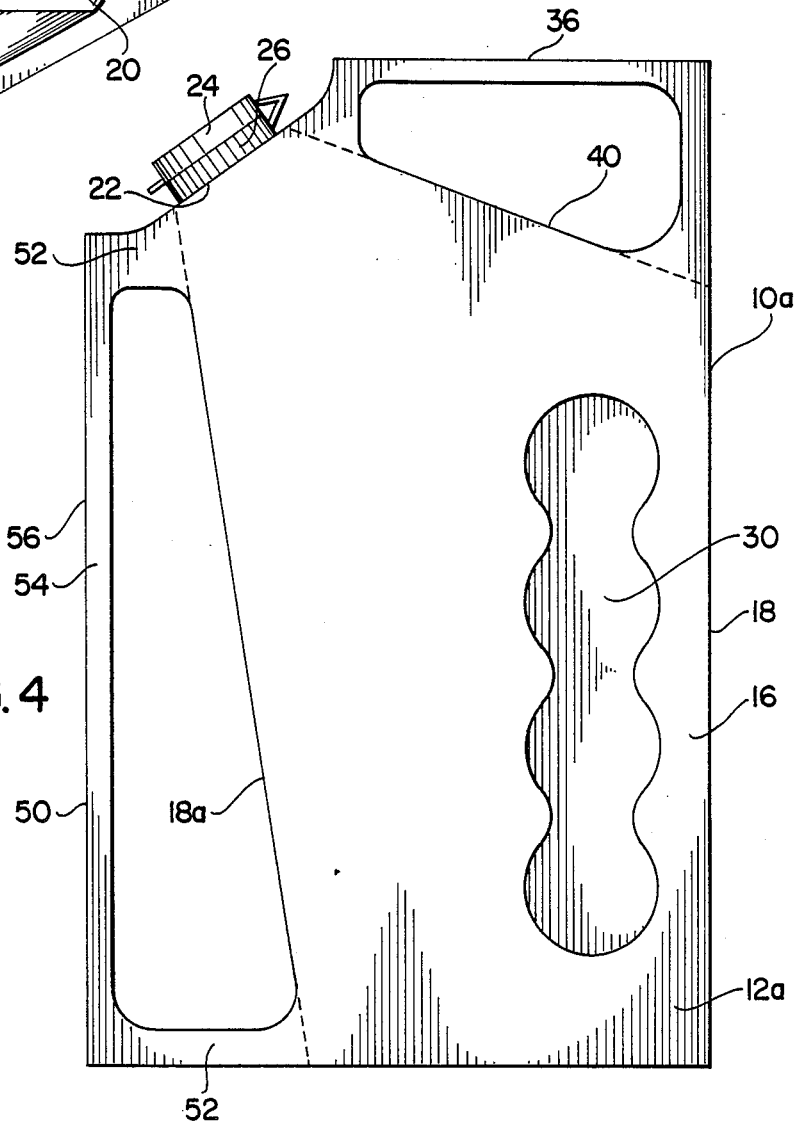
FIG. 4 is a side elevational view similar to FIG. 1 but showing an alternate container construction.

Turning now to the FIG. 4 drawing, an alternate container construction is depicted. Such container 10*a*, in addition to the construction previously described, includes a modified side panel 18*a* formed proximal to the dispensing opening 22. Such wall 18*a* instead of being vertically disposed in downwardly inwardly disposed and terminates at its upper end in a disposition vis-a-vis the dispensing opening 22 such that the dispensing opening 22 is in line or slightly below its connection therewith. Also, the side wall 18*a* is provided with a side support 50 similar in construction to the top support 36 in that it includes sidewardly outwardly extending brackets 52 and 54 connected by an upright connecting wall 54 which is vertically disposed and generally parallel to the opposed side panel 18. Such connecting wall 54 includes a side supporting surface 56 which is generally flat and adapted to support the container in a second alternate position, that is, in a position rotated 90 degrees in a counterclockwise motion from that shown in FIG. 4. In such position, the surface 56 would be utilized to support the container 10*a* in a manner such that liquid contained therein may drain along the side panel 18*a* sloped inner surface towards and collect at an area proximal to the dispensing opening 22 much in the same manner the top wall 40 functioned in the previous embodiment to accommodate such dispensing when the container was used in its first alternate position as shown in FIG. 2.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A dispensing container for assuring complete drainage of liquids especially slow flow liquids contained therein, said container having a bottom wall for normally supporting said container in a first non-dispensing upright position, side walls extending upwardly therefrom and a connecting top wall, a dispensing opening and closure disposed in said top wall proximal one side thereof, said top wall evenly sloping downwardly in a generally straight line from said one side proximal to said dispensing opening to the top wall side opposite said one side, and an upper support spaced above said top wall and having an upper generally flat supporting surface generally parallel to said bottom wall such that liquid drains by gravity from said top wall to said opening when said container is supported in an inverted alternate dispensing position by said upper supporting surface.

2. The container of claim 1, said side walls forming a generally rectangular cross-sectionally shaped container body and including pairs of opposed side panels and end panels integrally connected with said side panels, there being first hand grip means disposed in said panels at a position distal from said dispensing opening.

3. The container of claim 1, said upper support including a pair of longitudinally-spaced end posts integral with said top wall and said top supporting surface longitudinally disposed between said posts and having a narrowed intermediate portion forming a hand grip means for handling said container.

4. The container of claim 1, said upper support including a pair of longitudinally-spaced end posts integral with said top wall and said top supporting surface longitudinally disposed between said posts and having a narrowed intermediate portion forming a second hand grip means for handling said container.

5. The container of claim 1, said first hand grip means being elongated between said bottom and top walls.

6. A dispensing container for assuring complete drainage of liquids especially slow flow liquids contained therein, said container having a bottom wall for normally supporting said container in a first non-dispensing upright position, side walls extending upwardly therefrom and a connecting top wall, a dispensing opening and closure disposed in said top wall proximal one side thereof, said top wall sloping downwardly from said one side proximal to said dispensing opening to the top wall side opposite said one side, and an upper support spaced above said top wall and having an upper generally flat supporting surface generally parallel to said bottom wall such that liquid drains by gravity from said top wall to said opening when said container is supported in an inverted alternate dispersing position by said upper supporting surface, said side walls forming a generally rectangular cross-sectionally shaped container body and including pairs of opposed side panels and end panels integrally connected with said side panels, there being first hand grip means disposed in said side panels at a position distal from said dispensing opening, said end panel proximal to said dispensing opening downwardly inwardly sloped towards said bottom wall, and a side support spaced from said proximal end panel and having a generally flat side supporting surface generally parallel to said other end wall such that liquid drains by gravity from said proximal end panel to said opening when said container is supported in a second alternate dispensing position by said side supporting surface.

7. The container of claim 6, both said upper support and said side support each including a hand grip opening.

* * * * *